US008773486B2

(12) United States Patent
Nakamura et al.

(10) Patent No.: US 8,773,486 B2
(45) Date of Patent: Jul. 8, 2014

(54) OPTICAL ELEMENT RETAINER AND IMAGE FORMING APPARATUS INCLUDING THE OPTICAL ELEMENT RETAINER

(71) Applicants: Kenji Nakamura, Osaka (JP); Haruo Hashimoto, Osaka (JP)

(72) Inventors: Kenji Nakamura, Osaka (JP); Haruo Hashimoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/799,315

(22) Filed: Mar. 13, 2013

(65) Prior Publication Data

US 2013/0278705 A1 Oct. 24, 2013

(30) Foreign Application Priority Data

Apr. 23, 2012 (JP) ..... 2012-097709

(51) Int. Cl.
*B41J 2/45* (2006.01)

(52) U.S. Cl.
USPC ..... 347/238

(58) Field of Classification Search
USPC ..... 347/230, 238, 241, 242, 245, 256, 257, 347/263
See application file for complete search history.

(56) References Cited

U.S. PATENT DOCUMENTS

| | | | | |
|---|---|---|---|---|
| 6,252,619 | B1 * | 6/2001 | Ueda et al. | 347/138 |
| 8,040,368 | B2 * | 10/2011 | Yokoi | 347/242 |
| 8,400,481 | B2 * | 3/2013 | Sakai et al. | 347/138 |

FOREIGN PATENT DOCUMENTS

| | | |
|---|---|---|
| JP | 2007-065125 | 3/2007 |
| JP | 2009-157001 | 7/2009 |
| JP | 2010-271743 | 12/2010 |
| JP | 2012-058287 | 3/2012 |

* cited by examiner

*Primary Examiner* — Hai C Pham
(74) *Attorney, Agent, or Firm* — Harness, Dickey & Pierce, P.L.C.

(57) ABSTRACT

An image forming apparatus includes a main-body housing, a cover rotatably attached to the main-body housing, a latent image bearing member provided in the housing, an optical writing head to write a latent image on the latent image bearing member, a head retainer rotatably attached to the cover to hold the optical writing head, a biasing member to bias the head retainer in a rotation direction thereof, and a guide member. The guide member provided to the main-body housing is pressed by the optical writing head biased by the biasing member while guiding the optical writing head in a first direction and a second direction in association with movement of the cover. The first direction is a direction in which the optical writing head approaches the latent image bearing member, and the second direction is a direction in which the optical writing head separates from the latent image bearing member.

10 Claims, 10 Drawing Sheets

OPTICAL ELEMENT RETAINER AND IMAGE FORMING APPARATUS INCLUDING THE OPTICAL ELEMENT RETAINER

CROSS-REFERENCE TO RELATED APPLICATIONS

This patent application is based on and claims priority pursuant to 35 U.S.C. §119 to Japanese Patent Application No. 2012-097709, filed on Apr. 23, 2012, in the Japan Patent Office, the entire disclosure of which is hereby incorporated by reference herein.

BACKGROUND OF THE INVENTION

1. Field of the Invention

Exemplary aspects of the present invention generally relate to an image forming apparatus, such as a copier, a facsimile machine, a printer, or a multi-functional system including a combination thereof.

2. Description of the Related Art

Conventionally, there is known an optical writing device employed in an electrophotographic image forming apparatus, which uses an LED head including light emitting diodes to illuminate a photosensitive drum with light. Generally, the LED head is disposed near the photosensitive drum. If the photosensitive drum or peripheral parts need to be removed or replaced, the LED head hinders replacement of these devices. In order to facilitate replacement of these devices, in one approach, the LED head is movable relative to the photosensitive drum.

For example, the LED head is attached to a movable cover provided to the upper portion of the image forming apparatus so that the LED head and the cover move together as a single integrated unit. As the cover is moved to open, the LED head is separated from the photosensitive drum.

In order to facilitate an understanding of the novel features of the present invention, as a comparison a description is provided of a conventional LED-head retainer with reference to FIGS. 10 and 11. As illustrated in FIG. 10, a plurality of LED heads 100 is attached to a cover 300 via head retainers 200. Each of the head retainers 200 includes a link member 200*a* attached to the cover 300 and a holding member 200*b* that holds the LED head 100. The link member 200*a* is rotatably attached to the cover 300. The holding member 200*b* is rotatably attached to the link member 200*a*. In other words, each LED head 100 is held by the head retainer 200 with two rotation axes. In this example, when the cover 300 is opened upward, each LED head 100 moves upward together with the cover 300, separating from photosensitive drums 400.

As illustrated in FIG. 11, each head retainer 200 includes a guide rib 500 which is inserted between a rib 600 and an arm 700 serving as guide members provided at an image forming apparatus main body side as the cover 300 is closed. In this configuration, the LED heads 100 are guided towards the photosensitive drums 400 and positioned in place in the width direction of the LED heads 100 (or the horizontal direction in FIG. 11).

Although advantageous, because the head retainer 200 is rotatable freely at two locations, when the guide members of the main body side guide the head retainer 200, the head retainer 200 may not reliably contact the guide members.

In view of the above, there is thus an unsolved need for an image forming apparatus capable of reliably guiding an optical writing head to a proper position.

SUMMARY OF THE INVENTION

In view of the foregoing, in an aspect of this disclosure, there is provided an improved image forming apparatus including a main-body housing, a cover, a latent image bearing member, an optical writing head, a head retainer, a biasing member, and a guide member. The cover is rotatable about a shaft and rotatably attached to the main-body housing. The latent image bearing member is provided to the main-body housing and bears a latent image. The optical writing head writes the latent image on the latent image bearing member at a position close to the latent image bearing member. The head retainer is rotatably attached to the cover and holds the optical writing head. The biasing member biases the head retainer in a rotation direction thereof. The guide member is provided to the main-body housing and pressed by the optical writing head biased by the biasing member while guiding the optical writing head in a first direction and a second direction in association with movement of the cover. The first direction is a direction in which the optical writing head approaches the latent image bearing member, and the second direction is a direction in which the optical writing head separates from the latent image bearing member.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
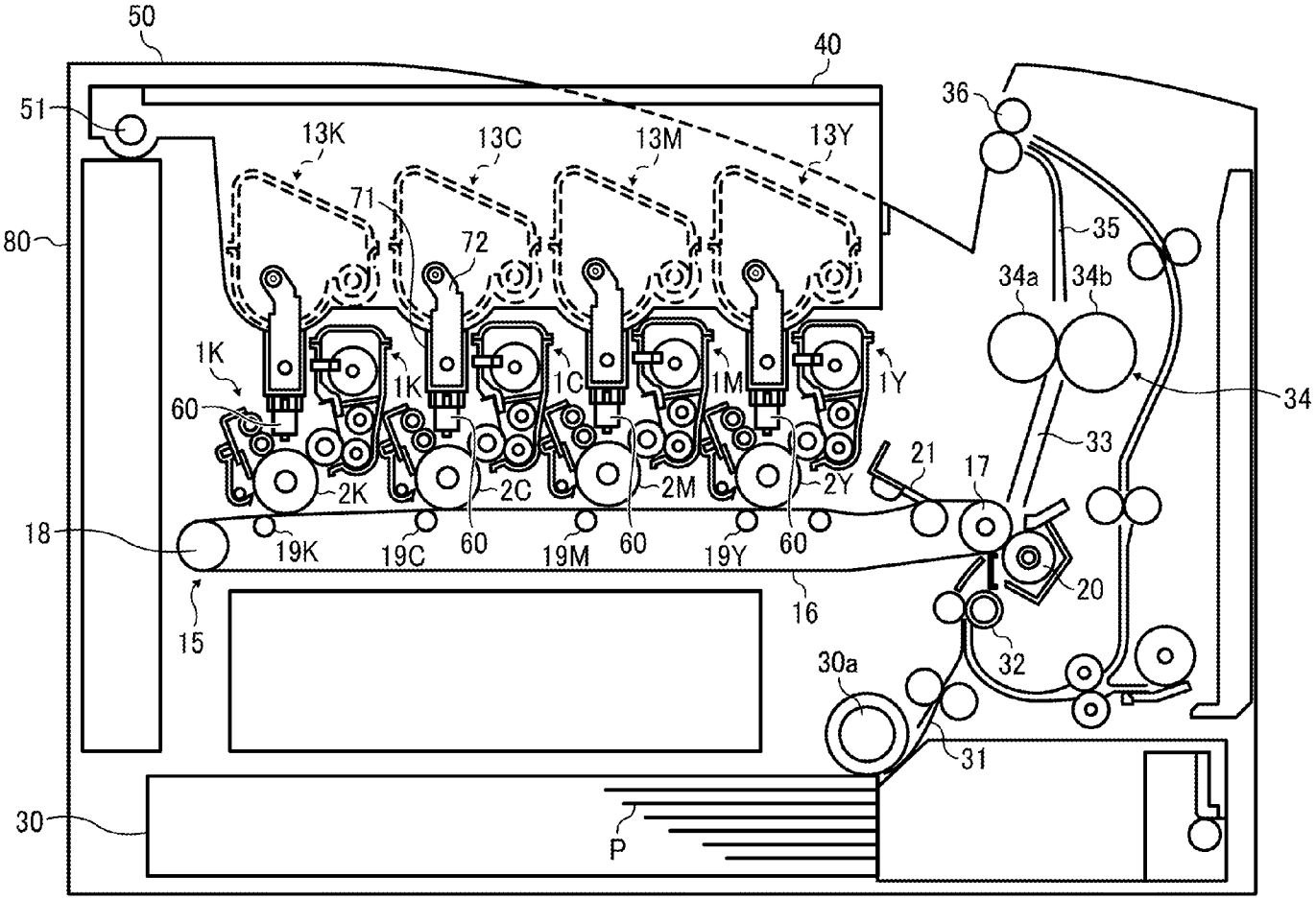
FIG. 1 is a schematic diagram illustrating a color laser printer as an example of the image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 shows the image forming apparatus as viewed from the lateral side thereof. The right side in FIG. 1 corresponds to the front side of the image forming apparatus, and the left side corresponds to the rear side thereof.

As illustrated in FIG. 1, the image forming apparatus is a printer and includes four image forming units 1Y, 1M, 1C, and 1K (which may be collectively referred to as image forming units 1) for forming toner images of yellow, magenta, cyan, and black, respectively. It is to be noted that these suffixes Y, M, C, and K denote colors yellow, magenta, cyan, and black, respectively. To simplify the description, these suffixes are omitted herein, unless otherwise specified.

The image forming units 1Y, 1M, 1C, and 1K all have the same configuration as all the others, differing only in the color of toner employed. Thus, a description is provided of the image forming unit 1K for forming a toner image of black as a representative example of the image forming units 1. The image forming units 1Y, 1M, 1C, and 1K are replaceable upon reaching their product life cycles.

Figure 2:
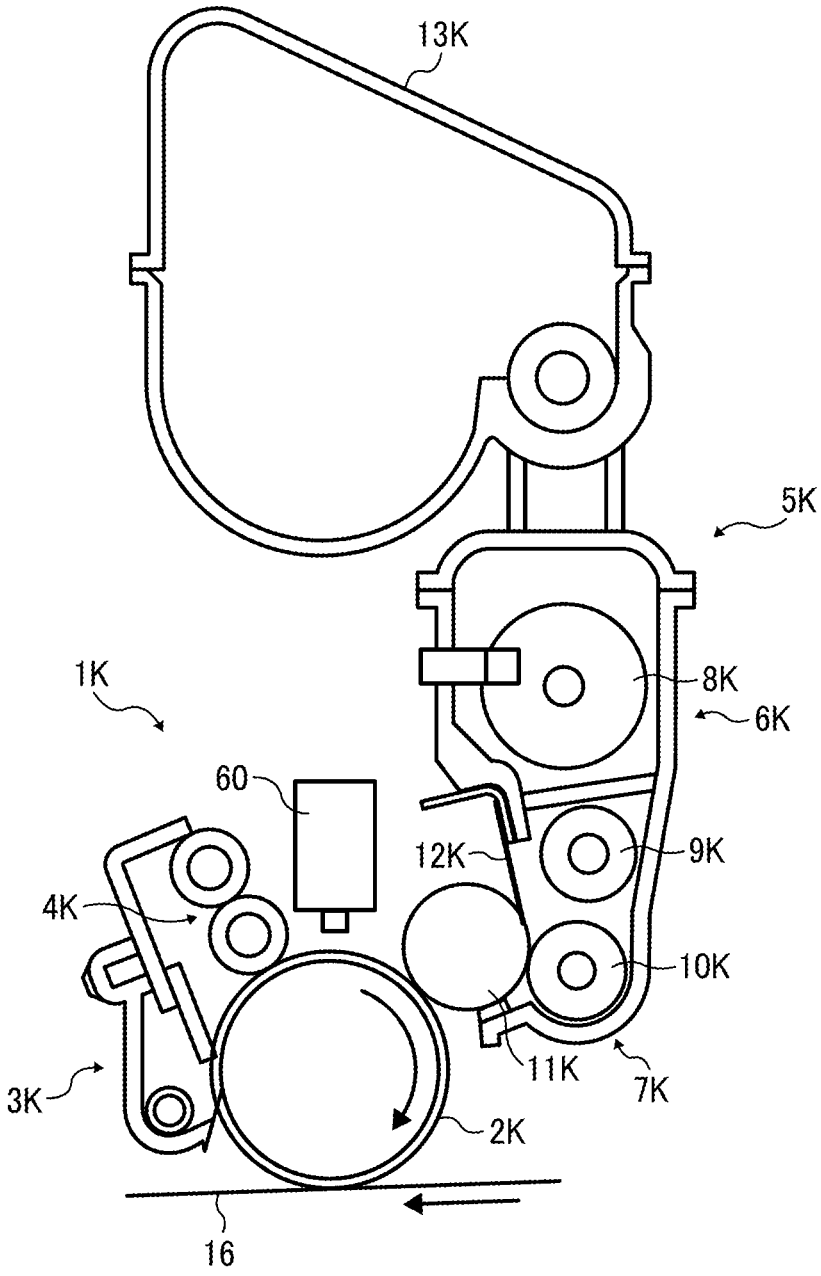
FIG. 2 is a schematic cross-sectional diagram schematically illustrating an image forming unit employed in the image forming apparatus of FIG. 1.

With reference to FIG. 2, a description is provided of the image forming unit 1K as an example of the image forming units 1. FIG. 2 is a schematic diagram illustrating the image forming unit 1K. The image forming unit 1K includes a drum-type photosensitive member 2K (hereinafter referred to as photosensitive drum) serving as a latent image bearing member surrounded by various pieces of imaging equipment, such as a charging device 4K, a developing device 5K, a drum cleaner 3K, and a charge neutralizing device (not illustrated). The image forming unit 1K is detachably attachable relative to the image forming apparatus, thereby allowing replacement of consumables at once. A toner cartridge 13K is provided at the upper portion of the image forming unit 1K. Toner is supplied from the toner cartridge 13K to the developing device 5K. According to the present illustrative embodiment, the image forming unit 1K and the toner cartridge 13K constitute independent members.

Referring back to FIG. 1, the image forming apparatus includes a main-body housing 80 to which an upper cover 50 and a middle cover 40 are rotatably attached. More specifically, the upper cover 50 and the middle cover 40 are rotatable about a rotary shaft 51. The toner cartridge 13K is held by the middle cover 40. By rotating the upper cover 50 to an open position, the toner cartridge 13K can be replaced. The image forming unit 1K can be replaced by rotating the upper cover 50 and the middle cover 40 to open.

When image forming operation is started, the photosensitive drum 2K is rotated by a drive device in the clockwise direction in FIG. 2. Subsequently, while rotating, the surface of the photosensitive drum 2K is charged uniformly by the charging device 4K. The uniformly charged surface of the photosensitive drum 2K is exposed by an optical writing head 60, thereby forming an electrostatic latent image for black color on the surface. The electrostatic latent image for black on the photosensitive drum 2K is developed with black toner by the developing device 5K. Accordingly, a visible image, also known as a toner image of black, is formed.

Subsequently, the black toner image formed on the photosensitive drum 2K is transferred onto an intermediate transfer belt 16. The drum cleaner 3K removes residual toner remaining on the photosensitive drum 2K after the transfer process. The charge neutralizer removes residual charge remaining on the photosensitive drum 2K after the surface thereof is cleaned by the drum cleaner 3K in preparation for the subsequent imaging cycle. Accordingly, the surface of the photosensitive drum 2K is initialized. Similar to the image forming unit 1K, toner images are formed on the photosensitive drums 2Y, 2M, and 2C, and then transferred to the intermediate transfer belt 16.

As illustrated in FIG. 2, the developing device 5K includes a vertically-long toner hopper 6K storing black toner and a developing portion 7K. In order to store a predetermined amount of toner in the toner hopper 6K, toner is supplied from the toner cartridge 13K to the toner hopper 6K as the toner is consumed during printing. The toner hopper 6K includes an upper screw 8K and a lower screw 9K disposed below the upper screw 8K. The upper screw 8K and the lower screw 9K are rotated by a drive device. Substantially below the lower screw 9K, a toner feed roller 10K rotated by the drive device is disposed.

The black toner in the toner hopper 6K is mixed by the upper screw 8K and the lower screw 9K and moves to the toner feed roller 10K under its own weight. The toner feed roller 10K includes a metal cored bar covered with a foam resin or the like and rotates while the toner in the developing device 5K is adhered to the surface of the roller 10K.

The developing portion 7K of the developing device 5K includes a developing roller 11K and a blade 12K. The developing roller 11K rotates while contacting the photosensitive drum 2K and the toner feed roller 10K. The tip of the blade 12K contacts the surface of the developing roller 11K. The black toner adhered to the toner feed roller 10K in the toner hopper 6K is supplied to the surface of the developing roller 11K at a contact portion at which the developing roller 11K and the toner feed roller 10K contact. As the supplied black toner passes through a place at which the developing roller 11K and the blade 12K contact, the thickness of the toner layer on the surface of the developing roller 11K is thinned or adjusted to a proper thickness. After the thickness of the toner layer is adjusted, at a developing area at which the developing roller 11K and the photosensitive drum 2K contact, the toner is adhered to the electrostatic latent image on the surface of the photosensitive drum 2K. Accordingly, the electrostatic latent image is developed with black toner into a visible image known as a black toner image.

Similar to the image forming unit 1K, toner images of yellow, magenta, and cyan are formed on the photosensitive drums 2Y, 2M, and 2C of the image forming units 1Y, 1M, and 1C, respectively.

In FIG. 1, the optical writing head 60 is disposed substantially above each of the photosensitive drums 2Y, 2M, 2C, and 2K (which may be collectively referred to as photosensitive drums 2) in the vertical direction. Each optical writing head 60 is biased against the photosensitive drums 2Y, 2M, 2C, and 2K by a biasing member. The optical writing head 60 includes light emitting elements such as LEDs arranged in the longitudinal direction of the photosensitive drums 2. The optical writing heads 60 illuminate the photosensitive drums 2 via rod lenses arranged also in the longitudinal direction of the photosensitive drums.

The light emitting element is not limited to an LED. Alternatively, an organic EL device may be employed. Based on image information, the light emitting elements disposed at a predetermined position in the optical writing head 60 project light to expose the photosensitive drums 2Y, 2M, 2C, and 2K of the image forming units 1Y, 1M, 1C, and 1K, respectively. Accordingly, yellow, magenta, cyan, and black electrostatic latent images are formed on the respective photosensitive drums 2Y, 2M, 2C, and 2K.

As illustrated in FIG. 1, a transfer unit 15 is disposed vertically below the image forming units 1Y, 1M, 1C, and 1K. The transfer unit 15 serving as a transfer mechanism includes the intermediate transfer belt 16 entrained around and stretched taut between a plurality of rollers, thereby forming a loop and rotating endlessly in the counterclockwise direction. The transfer unit 15 also includes a driving roller 17, a driven roller 18, four primary transfer rollers 19Y, 19M, 19C, and 19K, a secondary transfer roller 20, a belt cleaning device 21, and so forth.

The intermediate transfer belt 16 is entrained around the driving roller 17, the driven roller 18, and four primary transfer rollers 19Y, 19M, 19C, and 19K. The driving roller 17 is rotated in the counterclockwise direction by a driving device such as a motor or the like, and rotation of the driving roller 17 enables the intermediate transfer belt 16 to rotate in the same direction.

The intermediate transfer belt 16 is interposed between the photosensitive drums 2Y, 2M, 2C, and 2K, and the primary transfer rollers 19Y, 19M, 19C, and 19K. Accordingly, a primary transfer nip is formed between the front surface (outer surface) of the intermediate transfer belt 16 and the photoconductive drums 2 contacting the intermediate transfer belt 16. The primary transfer rollers 19Y, 19M, 19C, and 19K are supplied with a primary bias by a transfer bias power source, thereby generating a transfer electric field between the electrostatic latent images on the photosensitive drums 2Y, 2M, 2C, and 2K, and the primary transfer rollers 19Y, 19M, 19C, and 19K, respectively.

According to the present illustrative embodiment, a roller-type primary transfer device is used as the primary transfer rollers 19Y, 19M, 19C, and 19K. Alternatively, a transfer charger and a brush-type transfer device may be employed as a primary transfer device.

The yellow toner image formed on the photosensitive drum 2Y of the image forming unit 1Y enters the primary transfer nip as the photosensitive drum 2Y rotates. Subsequently, as the intermediate transfer belt 16 rotates, passing through the primary transfer nips for the colors magenta, cyan, and black, the toner images of the colors magenta, cyan, and black formed on the photosensitive drums 2M, 2C, and 2K are primarily transferred onto the intermediate transfer belt 16 so that they are superimposed one atop the other, thereby forming a composite toner image on the intermediate transfer belt 16.

The secondary transfer roller 20 of the transfer unit 15 is disposed outside the loop formed by the intermediate transfer belt 16, opposite the driving roller 17 which is disposed inside the looped intermediate transfer belt 16. The intermediate transfer belt 16 is interposed between the driving roller 17 and the secondary transfer roller 20, thereby forming a secondary transfer nip between the front surface of intermediate transfer belt 16 and the secondary transfer roller 20. The secondary transfer roller 20 is supplied with a secondary transfer bias from a secondary transfer bias power source. Upon application of the secondary transfer bias, a secondary transfer electric field is formed between the secondary transfer roller 20 and the driving roller 17 which is grounded.

A sheet cassette 30 storing a stack of recording media P is disposed vertically below the transfer unit 5 and is slidably detachable and attachable relative to the main-body housing 80 of the image forming apparatus. The sheet cassette 30 is equipped with a sheet feed roller 30*a* to contact a top sheet of the stack of recording media sheets P. As the sheet feed roller 30*a* is rotated at a predetermined speed, the sheet feed roller 30*a* picks up the recording medium P and sends it to a sheet path 31.

Substantially at the end of the sheet path 31, a pair of registration rollers 32 is disposed to feed the recording medium P to the secondary transfer nip described above. The pair of the registration rollers 32 stops rotating temporarily as soon as the recording medium P is interposed therebetween. The pair of registration rollers 32 starts to rotate again to feed the recording medium P to the secondary transfer nip in appropriate timing such that the recording medium P is aligned with the four-color composite toner image formed on the intermediate transfer belt 16 in the secondary transfer nip. In the secondary transfer nip, the recording medium P tightly contacts the composite toner image on the intermediate transfer belt 16, and the composite toner image is transferred onto the recording medium P by the secondary transfer electric field and the nip pressure applied thereto.

The recording medium P on which the composite color toner image is formed passes through the secondary transfer nip and separates from the secondary transfer roller 20 and the intermediate transfer belt 16. Subsequently, the recording medium P is delivered to a fixing device 34 via a post-transfer sheet path 33. After the intermediate transfer belt 16 passes through the secondary transfer nip, residual toner, which is toner not having been transferred onto the recording medium P, remains on the intermediate transfer belt 16. Such residual toner is removed from the intermediate transfer belt 16 by the belt cleaning device 21 that contacts the front surface of the intermediate transfer belt 16.

The fixing device 34 includes a fixing roller 34*a* and a pressing roller 34*b*. The fixing roller 34*a* includes a heat source such as a halogen lamp inside thereof. While rotating, the pressing roller 34*b* pressingly contacts the fixing roller 34*a*, thereby forming a heated area called a fixing nip therebetween. The recording medium P bearing an unfixed toner image on the surface thereof is delivered to the fixing device 34 and interposed between the fixing roller 34*a* and the pressing roller 34*b* at the fixing nip where the recording medium P contacts tightly the fixing roller 34*a*. Under heat and pressure in the fixing nip, the toner adhered to the toner image is softened and fixed to the recording medium P. Subsequently, the recording medium P is discharged outside the image forming apparatus from the fixing device 34 along a post-fixing sheet path 35 and stacked on a sheet stack portion which is an upper surface of the upper cover 50 after fixing.

Figure 3:
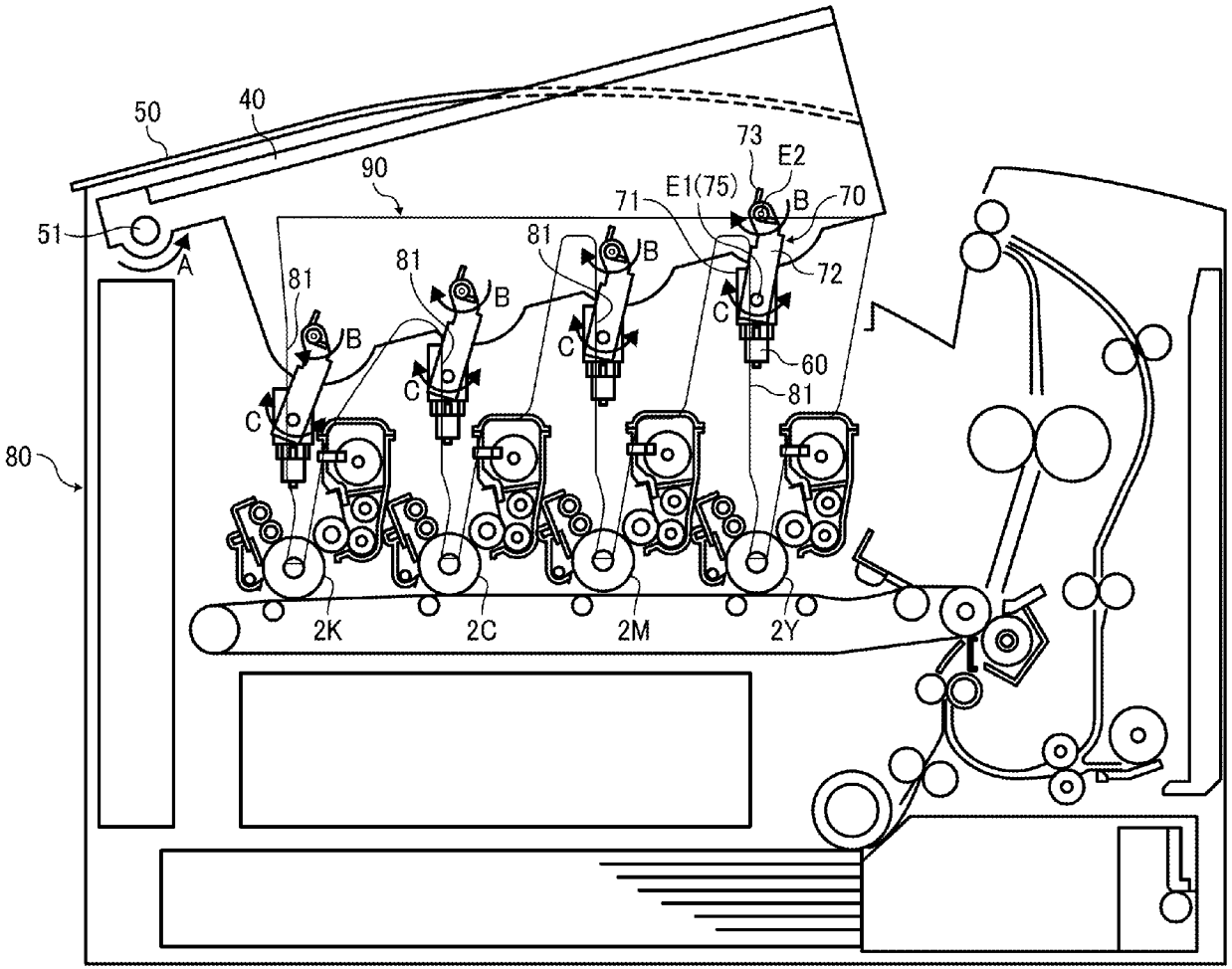
FIG. 3 is a schematic diagram illustrating a cover halfway through its open/close position.
Figure 4:
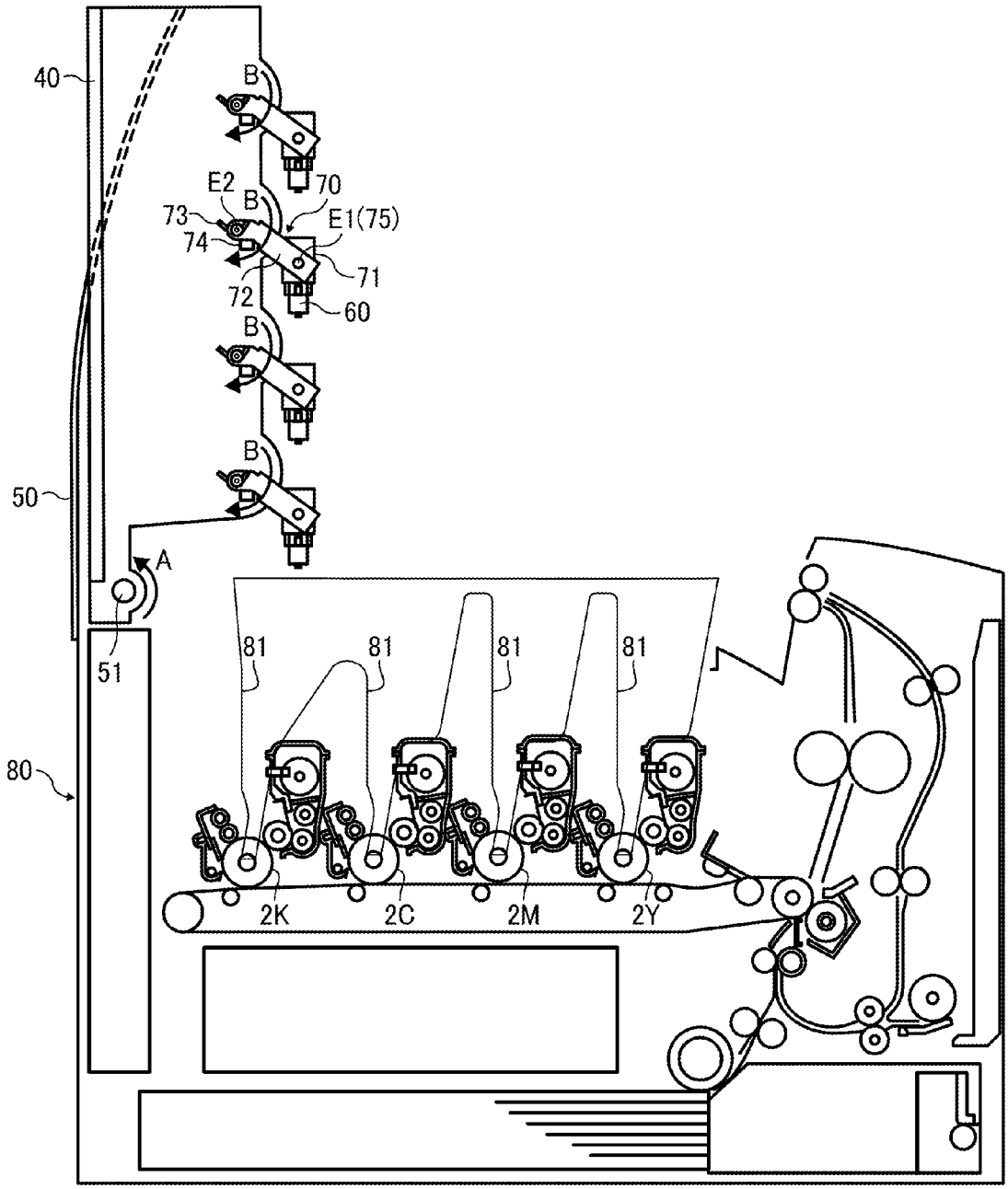
FIG. 4 is a schematic diagram illustrating the cover of FIG. 3 that is completely opened.

In a configuration in which the optical writing heads 60 are arranged near the photosensitive drums 2Y, 2M, 2C, and 2K such as in the present illustrative embodiment, upon replacement of the image forming units 1Y, 1M, 1C, and 1K as consumables, the optical writing heads 60 need to be separated from the photosensitive drums 2Y, 2M, 2C, and 2K so as not to hinder replacement operation. To counteract such difficulty, as will be described in detail with reference to FIGS. 3 and 4, separation of the optical writing heads 60 from the photosensitive drums 2Y, 2M, 2C, and 2K is associated with opening or rotation of the middle cover 40 in the direction of arrow A in FIGS. 3 and 4. FIG. 3 is a schematic diagram illustrating the middle cover 40 halfway through its open/close position. FIG. 4 is a schematic diagram illustrating the middle cover 40 that is completely opened.

As illustrated in FIGS. 3 and 4, each of the optical writing heads 60 is held by a head retainer 70 attached to the inside of the middle cover 40. It is to be noted that for the sake of simplicity, in FIGS. 3 and 4 the reference numbers are shown only for the head retainer 70 of one of the optical heads 60. Each of the head retainers 70 includes a head holding member 71 and a pair of link members 72 which holds each end surface of the head holding member 71.

The head holding member 71 holds the optical writing head 60. The head holding member 71 is rotatably held by the link members 72 such that the head holding member 71 is rotatable about a first rotary shaft E1 provided to one end portion of the pair of the link members 72. The other end of the link members 72 is rotatably attached to the middle cover 40 about a second rotary shaft E2. The first rotary shaft E1 and the second rotary shaft E2 are disposed parallel to the rotary shaft 51 of the middle cover 40.

Each pair of link members 72 is biased to rotate in the direction of arrow B in FIG. 3 by a torsion coil spring 73 serving as a biasing member provided to the second rotary shaft E2. In other words, each link member 72 is biased by the torsion coil spring 73 in a direction in which the optical writing head 60 approaches the rotary shaft 51 of the middle cover 40. The head holding member 71 is rotatable freely about the first rotary shaft E1 in the direction of arrow C in FIG. 3.

In a state in which the middle cover 40 is completely opened as illustrated in FIG. 4, each pair of the link members 72 is supported by contacting a stopper 74 provided to the middle cover 40. The stopper 74 stops the link members 72 at a predetermined position against pressure of the torsion coil spring 73. With this configuration, the optical writing head 60 is held at a position substantially close to the rotary shaft 51 side of the middle cover 40.

As illustrated in FIG. 3, the main-body housing 80 includes a plurality of guide members 81 extending in the vertical direction. Moving members 75 having a projecting shape are provided corresponding to the guide members 81, at the optical writing head side. The moving member 75 slidably moves relative to the respective guide member 81. In the present illustrative embodiment, the moving member 75 is provided on the first rotary shaft E1. As the moving member 75 slidably moves along the guide member 81, each optical head 60 is guided towards or away from the photosensitive drums 2Y, 2M, 2C, and 2K, drawing a predetermined trajectory.

The guide members 81 have different shapes in accordance with the trajectory of the optical heads 60 when the middle cover 40 is opened and closed. More specifically, the second guide member 81 from the rotary shaft 51 of the middle cover 40 is shorter in the vertical (up-down) direction than other guide members 81 so as not to interfere with the optical writing head 60 closest to the rotary shaft 51 of the middle cover 40.

As illustrated in FIG. 3, when the middle cover 40 is moved in the direction of arrow A, in sync with the movement of the middle cover 40, the optical writing heads 60 separate from the photosensitive drums 2Y, 2M, 2C, and 2K while the moving members 75 slidably move upward along the guide members 81. Subsequently, as the middle cover 40 is in an upright position, facing the vertical direction and is completely opened as illustrated in FIG. 4, the link members 72 are stopped by the stoppers 74 to prevent the link members 72 from rotating. In this state, the optical writing heads 60 are held facing down under its own weight.

When moving the middle cover 40 in the opposite direction to the direction of arrow A to close the middle cover 40, the optical writing heads 60 move downward in sync with closing of the middle cover 40. The moving members 75 come in contact with the respective guide members 81 and slidably move downward along the guide members 81. As the moving members 75 slidably move along the guide members 81, the optical writing heads 60 are guided towards the photosensitive drums 2Y, 2M, 2C, and 2K. When the middle cover 40 is completely closed, the optical writing heads 60 are brought close to the photosensitive drums 2Y, 2M, 2C, and 2K to illuminate.

Figure 5:
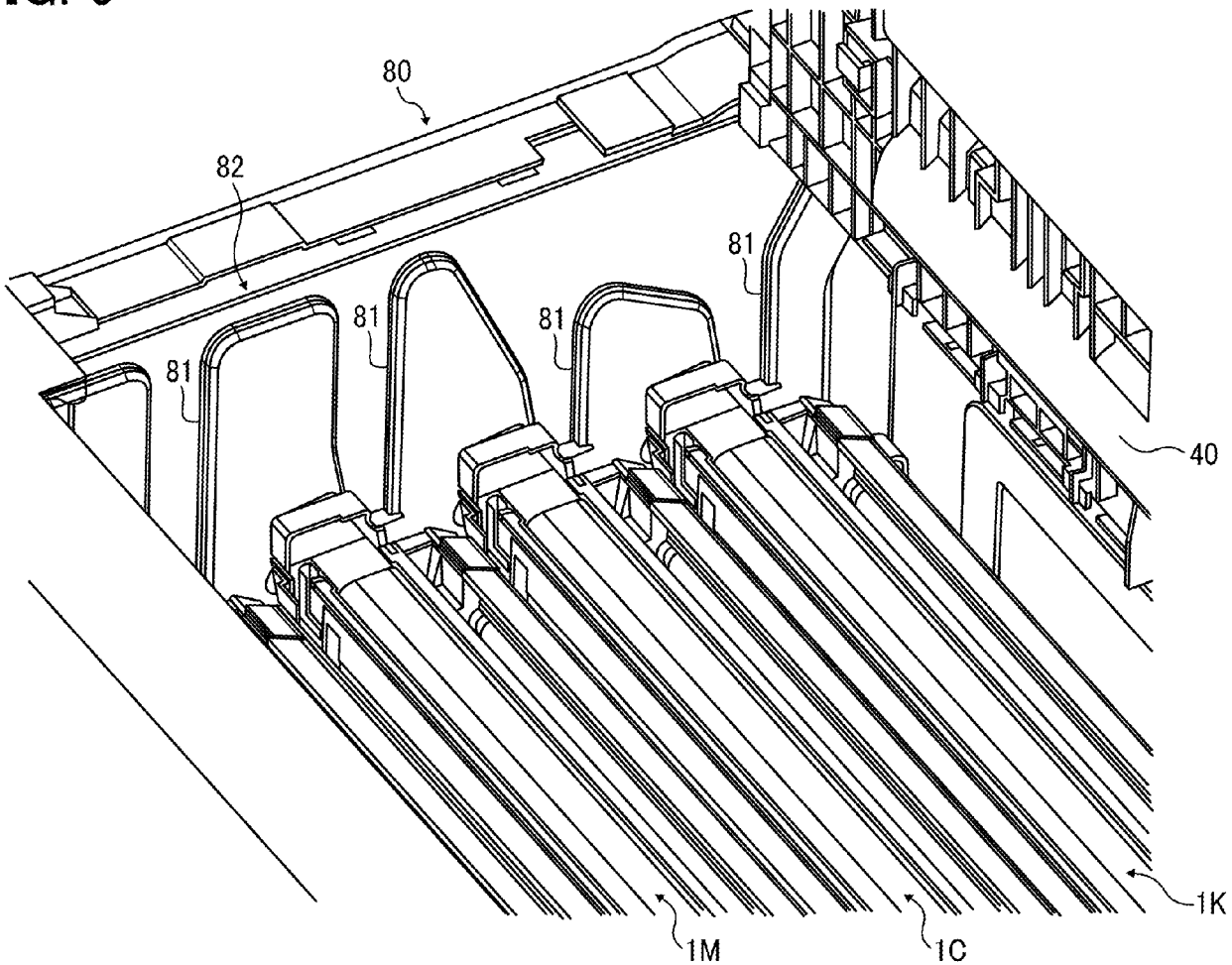
FIG. 5 is a partially enlarged schematic diagram illustrating an inside structure of the image forming apparatus when the cover is opened.

FIG. 5 shows an internal structure of the image forming apparatus with the middle cover 40 opened. As illustrated in FIG. 5, the main-body housing 80 includes a frame 82 which constitutes an inner surface of the main-body housing 80. Four guide members 81 described above are arranged next to each other on the frame 82.

According to the present illustrative embodiment, four guide members 81 and the frame 82 are constituted as a single mold member. More specifically, the frame 82 is made of sheet metal, and the guide members 81 are formed on the frame 82 through the drawing process in which the sheet metal is drawn to form projections serving as guide members 81. Alternatively, the plurality of guide members 81 may be made as a single integrated unit through metal molding.

As described above, although not illustrated, the guide members 81 are also provided to the opposite frame 82 across from the frame 82 shown in FIG. 5. Alternatively, the guide members 81 and the moving members 75 may be provided to only one side of the main-body housing 80 and the head retainer 70.

Figure 6:
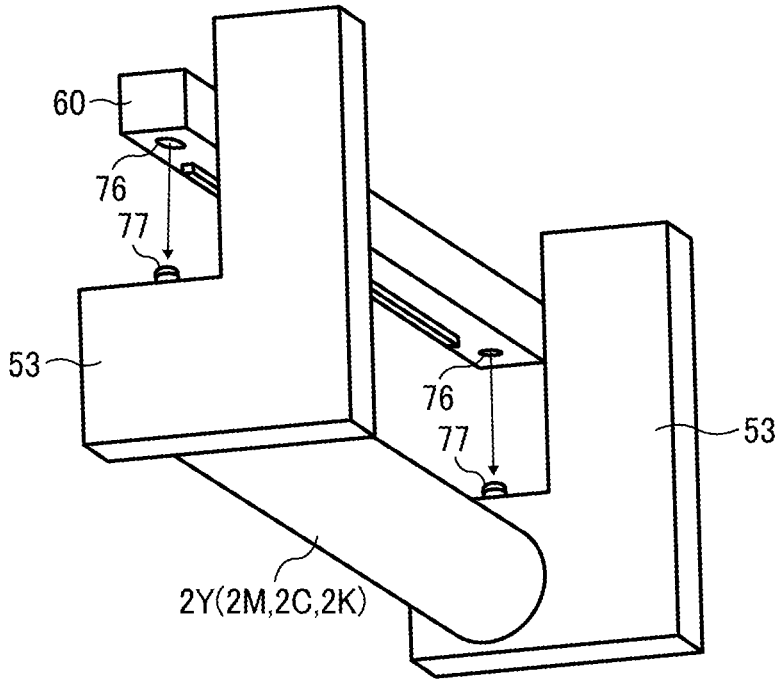
FIG. 6 is a schematic diagram illustrating a positioning mechanism for positioning an optical writing head in place relative to a photosensitive drum.

FIG. 6 shows a positioning mechanism that positions the optical writing heads 60 in place relative the photosensitive drums 2. FIG. 6 is a schematic diagram illustrating the positioning mechanism for positioning the optical writing heads 60 in place relative to the photosensitive drums 2.

As illustrated in FIG. 6, recessed portions 76 provided to the optical writing head side and projections 77 provided to the photosensitive drum side constitute the positioning mechanism. It is to be noted that FIG. 6 shows only one of the positioning mechanisms as a representative example. The positioning mechanisms for other optical heads 60 employ the same configuration as that of shown in FIG. 6.

The recessed portion 76 is provided to both ends of the optical writing head 60 in the longitudinal direction thereof. The projections 77 are provided to a housing 53 of the image forming unit 1 that holds both end portions of the photosensitive drums 2Y, 2M, 2C, and 2K. The recessed portions 76 and the projections 77 engage and separate from one another in the direction in which the guide member 81 guides the optical writing head 60. In this configuration, when closing the middle cover 40, the projections 77 engage the recessed portions 76, thereby positioning the optical writing heads 60 in place near the photosensitive drums 2. Alternatively, the projections 77 may be provided to the optical writing head side, and the recessed portions 76 may be provided to the photosensitive drum side.

Figure 7:
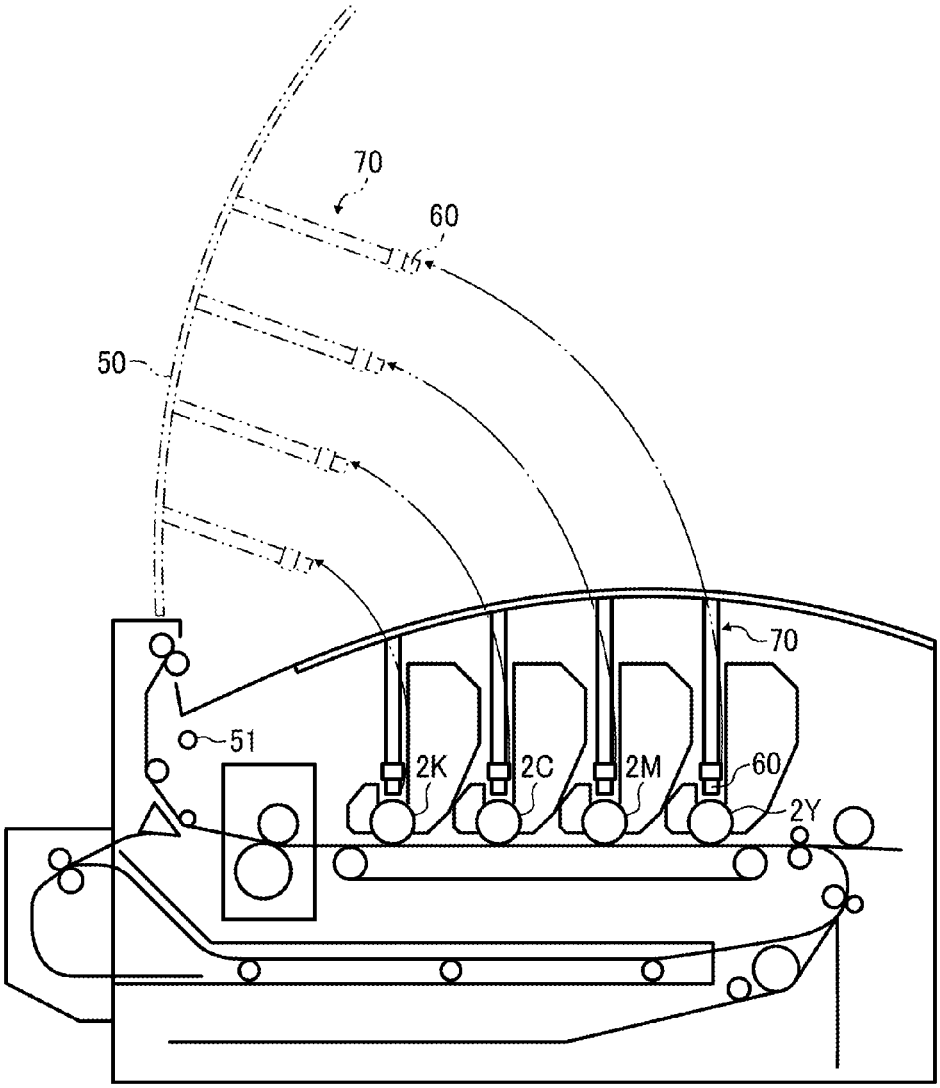
FIG. 7 is a schematic diagram illustrating an image forming apparatus of a first comparative example.
Figure 8:
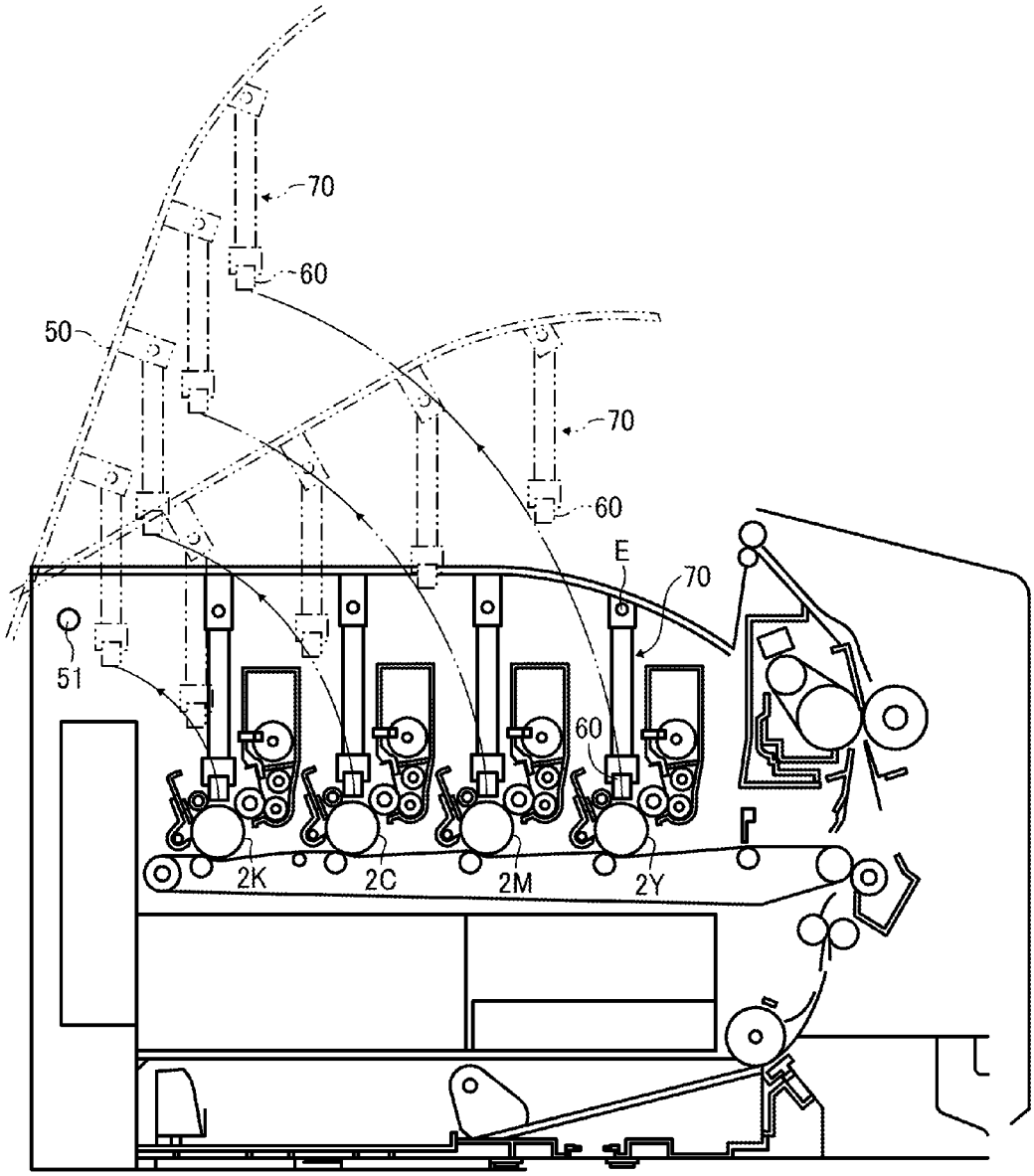
FIG. 8 is a schematic diagram illustrating an image forming apparatus of a second comparative example.

With reference to FIGS. 7 and 8, a description is provided of comparative examples. FIG. 7 is a schematic diagram illustrating an image forming apparatus of a first comparative example. FIG. 8 is a schematic diagram illustrating an image forming apparatus of a second comparative example. In the comparative examples, the structure of the head retainers 70 is different from the above described embodiment.

In the first comparative example, as illustrated in FIG. 7, the head retainers 70 are fixed to the upper cover 50, but the head retainers 70 are not rotatable as compared with the head retainers 70 of the illustrative embodiment of the present invention, which are rotatable. Furthermore, in the first comparative example, the optical writing heads 60 are not rotatably held by the head retainers 70.

In the second comparative example, as illustrated in FIG. 8, the head retainers 70 are rotatably attached to the upper cover 50 about a rotary shaft E. However, the optical writing heads 60 are not rotatably held relative to the head retainers 70. In other words, the head retainers 70 of the second comparative example are not rotatable at two places.

In the first comparative example, as illustrated in FIG. 7, as the upper cover 50 is opened, the optical writing heads 60 held by the head retainers 70 are separated from the photosensitive drums 2. In this configuration, a significant amount of the optical writing heads 60 projects from the inner surface of the upper cover 50. As a result, upon replacement and installation of the image forming unit 1 relative to the image forming apparatus by users or a technician, the image forming unit 1 or hands of the users and the technician may touch the optical writing heads 60 projecting from the upper cover 50. Because the optical writing heads 60 project from the inner surface of the upper cover 50 significantly, the trajectory of the optical writing heads 60 is far from the rotary shaft 51 of the upper cover 50, resulting in an increase in the size of the image forming apparatus.

By contrast, in the second comparative example as illustrated in FIG. 8, as the upper cover 50 is opened, the optical writing heads 60 and the head retainers 70 rotate downward, facing down under its own weight, the optical writing heads 60 are prevented from projecting from the inner surface of the upper cover 50. Accordingly, the optical writing heads 60 are prevented from getting touched by the image forming units 1 and hands, as compared with the first comparative example. Furthermore, the second comparative example is advantageous in that the distance between the rotary shaft 51 of the upper cover 50 and the trajectory of the optical writing heads 60 is relatively short.

Figure 9:
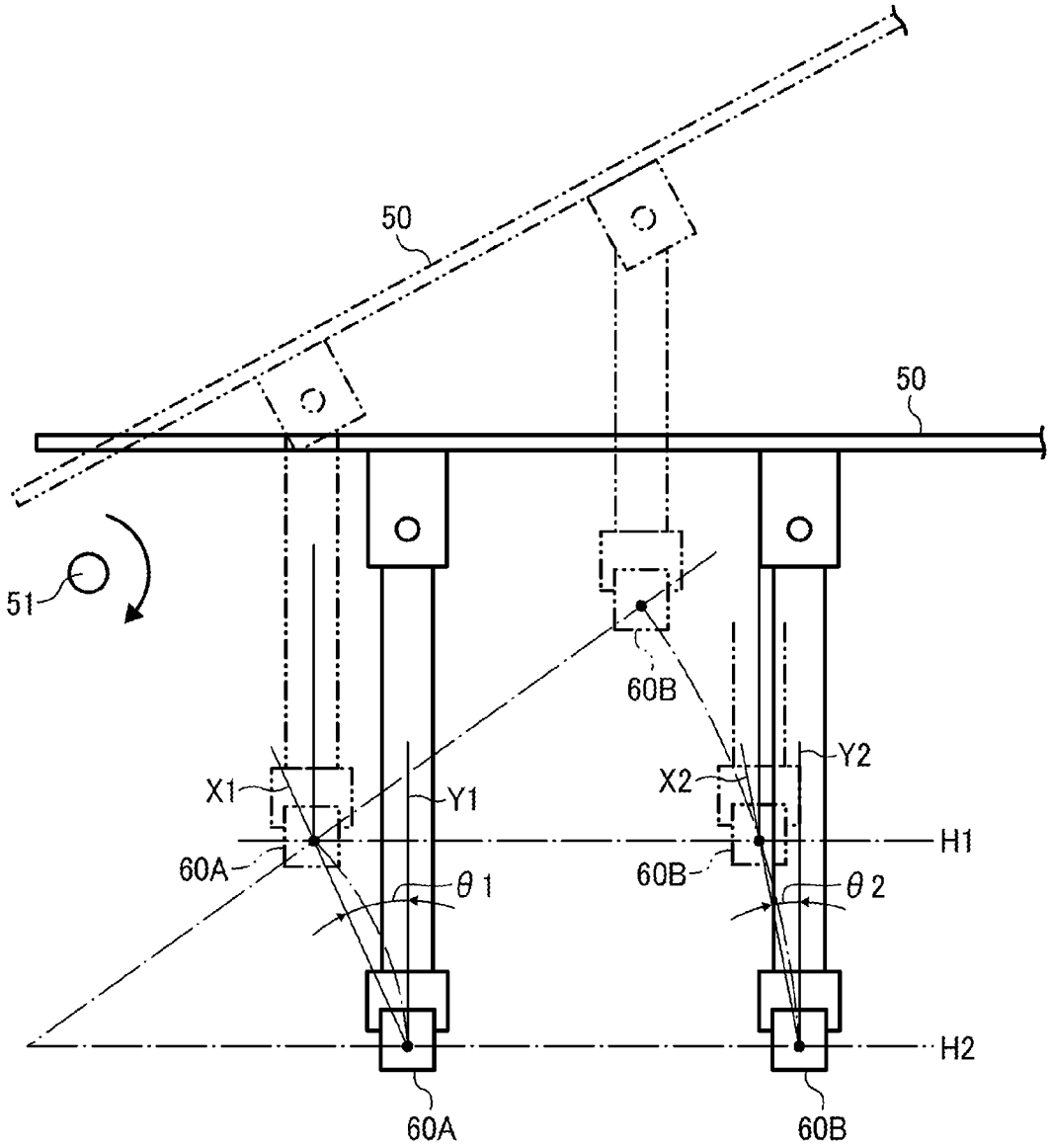
FIG. 9 is a diagram illustrating a trajectory of the optical writing head of the second comparative example.
Figure 10:
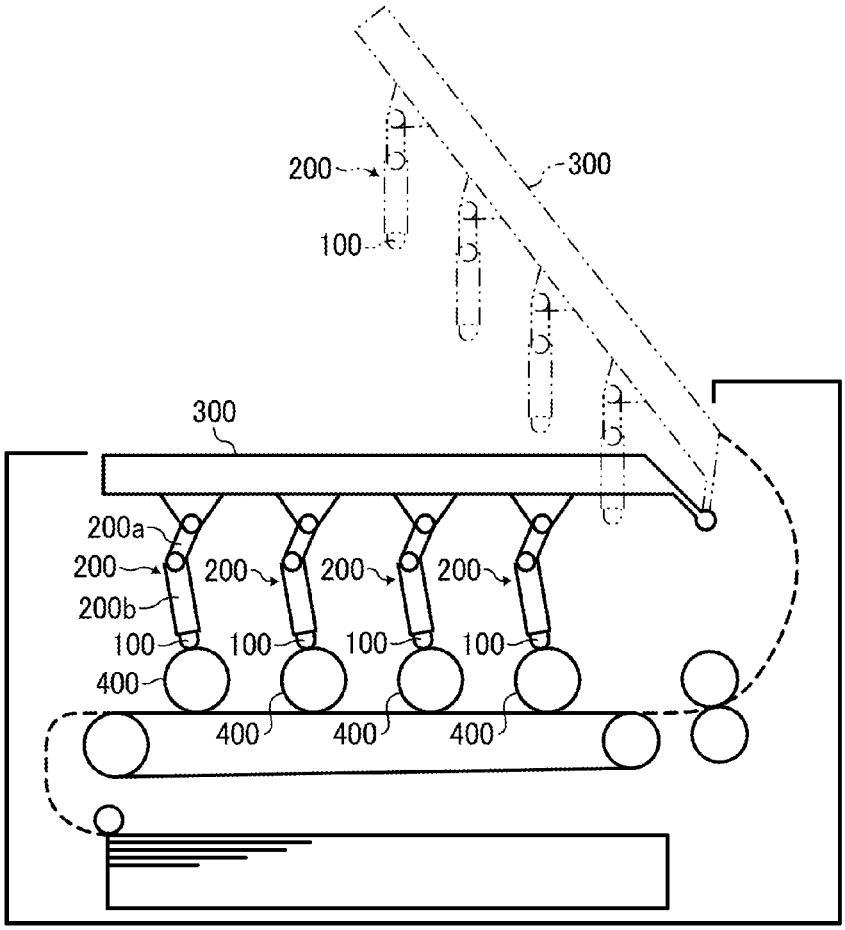
FIG. 10 RELATED ART
FIG. 10 is a schematic diagram illustrating a related-art image forming apparatus.

Although advantageous, in the second comparative example, the trajectory of movement of the optical writing head 60 closest to the rotary shaft 51 of the upper cover 50 among the plurality of optical writing heads 60 has a relatively small radius of curvature. Consequently, there is a possibility that the optical writing head 60 is not positioned properly and smoothly using the positioning mechanism shown in FIG. 6 which holds and releases the optical writing head 60 in the vertical direction. For example, in FIG. 9, when an optical writing head 60A disposed closest to the rotary shaft 51 and an optical writing head 60B disposed farther away from the rotary shaft 51 than from the optical writing head 60A move from a position H1 to a position H2 which is lower than the position H1, an angle θ1 of the optical writing head 60A is larger than an angle θ2 of an optical writing head 60B. The angle θ1 is an angle between a line X1 and a line Y1, where the line X1 is a line connecting two end points of the trajectory of the optical writing unit 60A at the position H1 and at the position H2, and the line Y1 is a vertical straight line from the end point of the trajectory of the optical writing unit 60A at the position H2. The angle θ2 is an angle between a line X2 and a line Y2, where the line X2 is a line connecting two end points of the trajectory of the optical writing unit 60B at the position H1 and at the position H2, and the line Y2 is a vertical straight line from the end point of the trajectory of the optical writing unit 60B at the position H2. In other words, because the optical writing head 60A moves in a more oblique manner relative to the direction of insert of the projection 77 to the recessed portion 76 than the optical writing head 60B disposed farther away from the optical writing head 60A, it is difficult to insert the projecting portion 77 to the recessed portion 76.

By contrast, according to the present illustrative embodiment, the head retainers 70 are rotatable at two locations, thereby allowing all the optical writing heads 60 to move in the vertical direction. As described above, according to the present illustrative embodiment, even when the distance between the plurality of head retainers 70 and the rotary shaft 51 of the middle cover 40 varies, the head retainers 70 can be moved with a desired trajectory regardless of the distance from the rotary shaft 51. With this configuration, the projections 77 are inserted easily and smoothly to the recessed portions 76, preventing displacement of the projections 77 and the recessed portions 76 and damage to the projections 77.

According to the present illustrative embodiment, the torsion coil springs 73 bias the link members 73 as the optical writing heads 60 are guided by the guide members 81, thereby enabling the moving members 75 to reliably contact the guide members 81. With this configuration, the optical writing heads 60 are reliably guided in sync with movement (opening and closing) of the middle cover 40.

With the middle cover 40 open, the link portions 72 are rotatably moved by the torsion coil springs 73, causing the optical writing heads 60 to approach the rotary shaft 51. Accordingly, the amount of the optical writing heads 60 projecting from the inner surface of the middle cover 40 can be reduced. Thus, the optical writing heads 60 are prevented from getting touched by the image forming units 1 and hands of users or technicians, while facilitating replacement of the process units 1.

According to the present illustrative embodiment, as the head retainers 70 are biased by the torsion coil springs 73, the optical writing units 60 are guided reliably by the guide members 81 and the optical writing units 60 are moved to a position which prevents the optical writing units 60 from contacting the photosensitive drums 2 when the cover is opened.

Figure 11:
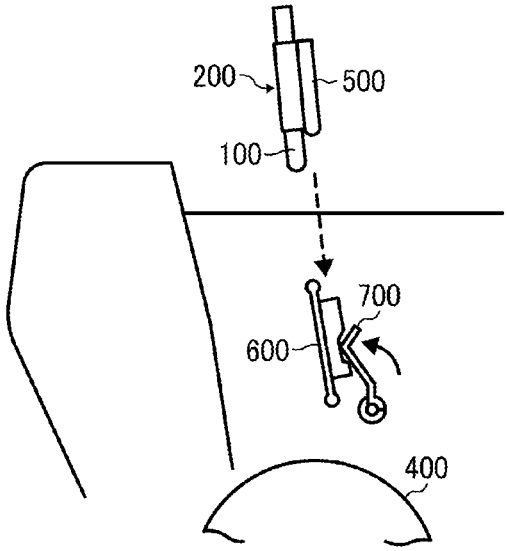
FIG. 11 RELATED ART
FIG. 11 is a schematic diagram illustrating a guide mechanism for an LED head employed in the related-art image forming apparatus of FIG. 10.

According to the present illustrative embodiment, the plurality of the guide members 81 are formed as a single integrated member through drawing process, thereby reducing the number of parts and mounting errors as compared with the known configuration using the rib 600 and the arm 700 as shown in FIG. 11. The positional accuracy of the guide members can be achieved at low cost with a single manufacturing step.

According to the illustrative embodiment, the present invention is employed in the color printer as an example of the image forming apparatus. The image forming apparatus includes, but is not limited to, a monochrome printer, a copier, a facsimile machine, and a multi-functional system. Furthermore, the present invention is applicable to an image forming apparatus including an upper cover only, without an middle cover.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a main-body housing;

a cover rotatable about a shaft and rotatably attached to the main-body housing;

a latent image bearing member disposed in the main-body housing, to bear a latent image;

an optical writing head to write the latent image on the latent image bearing member at a position close to the latent image bearing member;

a head retainer rotatably attached to the cover, to hold the optical writing head;

a biasing member to bias the head retainer in a rotation direction thereof; and a guide member provided to the main-body housing, the guide member being pressed by the optical writing head biased by the biasing member while guiding the optical writing head in a first direction and a second direction in association with movement of the cover;

a plurality of the optical writing heads;

a plurality of the head retainers;

a plurality of the biasing members; and a plurality of the guide members, wherein the first direction is a direction in which the optical writing head approaches the latent image bearing member and the second direction is a direction in which the optical writing head separates from the latent image bearing member, and wherein the plurality of the guide members has different shapes in accordance with trajectories of each of the optical writing heads upon opening and closing of the cover.

2. The image forming apparatus according to claim 1, wherein the biasing member biases the head retainer in a direction in which the optical writing head approaches the shaft of the cover.

3. The image forming apparatus according to claim 2, wherein the biasing member is a torsion coil spring.

4. The image forming apparatus according to claim 1, wherein the head retainer includes a holding member to hold the optical writing head and a link member including a first shaft and a second shaft;

wherein the link member holds rotatably the holding member about the first shaft and is attached rotatably to the cover about the second shaft.

5. The image forming apparatus according to claim 4, wherein the biasing member biases the link member in a direction of rotation thereof, and the holding member rotatably moves under its own weight.

6. The image forming apparatus according to claim 1, further comprising a positioning member to position the optical writing head at a predetermined position near the latent image bearing member.

7. The image forming apparatus according to claim 6, wherein the latent image bearing member is held by a housing, and the positioning member comprises a recessed portion and a projection that engages and separates from the recessed portion, wherein the recessed portion and projection are locked when the optical writing head is guided by the guide member in the first direction, and separate from one another when the optical writing head is guided by the guide member in the second direction;

wherein one of the recessed portion and the projection is provided to the optical writing head and another of the recessed portion and the projection is provided to the housing of the latent image bearing member.

8. The image forming apparatus according to claim 1, wherein the plurality of the head retainers is disposed such that the distance between each of the head retainers and the shaft of the cover is different from each other.

9. The image forming apparatus according to claim 1, wherein the plurality of guide members are molded as a single integrated unit.

10. An image forming apparatus, comprising:

a main-body housing;

a cover rotatable about a shaft and rotatably attached to the main-body housing;

a latent image bearing member disposed in the main-body housing, to bear a latent image;

an optical writing head to write the latent image on the latent image bearing member at a position close to the latent image bearing member;

a head retainer rotatably attached to the cover, to hold the optical writing head;

a biasing member to bias the head retainer in a rotation direction thereof;

a guide member provided to the main-body housing, the guide member being pressed by the optical writing head biased by the biasing member while guiding the optical writing head in a first direction and a second direction in association with movement of the cover; and a stopper to stop the head retainer at a predetermined position against the biasing force of the bias member in a state in which the cover is opened, wherein the first direction is a direction in which the optical writing head approaches the latent image bearing member and the second direction is a direction in which the optical writing head separates from the latent image bearing member.

* * * * *